US009272440B1

(12) United States Patent
Hutsell

(10) Patent No.: US 9,272,440 B1
(45) Date of Patent: Mar. 1, 2016

(54) SAW CHAIN CUTTER LINK HAVING END OF LIFE INDICATOR

(71) Applicant: Blount, Inc., Portland, OR (US)

(72) Inventor: Sam Hutsell, Portland, OR (US)

(73) Assignee: Blount, Inc., Portland, OR (US)

( * ) Notice: Subject to any disclaimer, the term of this patent is extended or adjusted under 35 U.S.C. 154(b) by 0 days.

(21) Appl. No.: 14/530,439

(22) Filed: Oct. 31, 2014

(51) Int. Cl.
*B27B 33/14* (2006.01)

(52) U.S. Cl.
CPC ..... *B27B 33/142* (2013.01); *Y10T 83/866* (2015.04); *Y10T 83/925* (2015.04)

(58) Field of Classification Search
CPC .... B27B 33/14; B27B 33/148; Y10T 83/925; Y10T 83/866
USPC ..... 83/830–834, 522.27
See application file for complete search history.

(56) References Cited

U.S. PATENT DOCUMENTS

| | | | | | |
|---|---|---|---|---|---|
| 2,857,942 | A | * | 10/1958 | Mall | 83/833 |
| 4,409,874 | A | * | 10/1983 | Nitschmann et al. | 83/833 |
| 4,762,044 | A | * | 8/1988 | Kolve | 83/832 |
| 5,029,501 | A | * | 7/1991 | Smith | 83/13 |
| 6,058,825 | A | * | 5/2000 | Harfst | 83/834 |
| 6,223,640 | B1 | * | 5/2001 | Sundstrom | 83/830 |
| 6,857,349 | B2 | * | 2/2005 | Duquet | 83/834 |
| 2010/0005666 | A1 | * | 1/2010 | Seigneur et al. | 30/138 |

FOREIGN PATENT DOCUMENTS

| | | | | |
|---|---|---|---|---|
| CA | 742935 | * | 9/1966 | B27B 33/14 |

* cited by examiner

*Primary Examiner* — Laura M Lee
(74) *Attorney, Agent, or Firm* — Schwabe Williamson & Wyatt

(57) ABSTRACT

Embodiments herein provide a cutter link having an end of life indicator to provide feedback to the user that the saw chain, and more specifically the cutter link(s), has been worn and/or sharpened to an undesirable state or degree. There is provided one or more disruptions to the cutting surface of a cutter link in a region that is past the manufacturer's recommended wear limit. When exposed, such disruptions in the cutting surface provide perceptible indications to the user that the chain should no longer be used.

13 Claims, 7 Drawing Sheets

A-A

A-A

SAW CHAIN CUTTER LINK HAVING END OF LIFE INDICATOR

TECHNICAL FIELD

Embodiments herein relate to the field of saw chain, and, more specifically, to a cutter link having an end of life indicator.

BACKGROUND

Saw chain for a chain saw typically includes various links collectively designed to provide a cutting function. In various saw chains, these links may include such elements as tie straps, drive links, and cutter links. The cutter links are arranged in a sequence along with other components to form a complete chain.

Important to the function of a saw chain is a continuous and sharp cutting edge along the working surface or surfaces of the cutter links. This cutting edge dulls as it is exposed to the cut media during typical operation, and therefore needs to be refreshed/sharpened periodically. The cutting edge may be refreshed by removing a small amount of material through the use of a sharpening tool, such as a hand file or grinding wheel. After many instances of sharpening a cutter link over its useful lifespan, a substantial amount of material may have been removed. Once the amount of material removed exceeds certain limits, such as the manufacturer's specified limits, which are typically based on analysis of increased risk of material tear, use of the saw chain should be discontinued and a replacement chain used in its place. The current state of the art, such as described in U.S. Pat. No. 4,554,853, utilizes visual markings to delineate the extent of material removal that the saw chain manufacturer deems safe, however these visual markings can themselves wear out during normal chain saw operation rendering them useless as an indicator of the end of life of the cutter link(s) when they are needed to provide such a function.

BRIEF DESCRIPTION OF THE DRAWINGS

Embodiments will be readily understood by the following detailed description in conjunction with the accompanying drawings and the appended claims.

Embodiments are illustrated by way of example and not by way of limitation in the figures of the accompanying drawings.

DETAILED DESCRIPTION OF DISCLOSED EMBODIMENTS

Figure 1A:
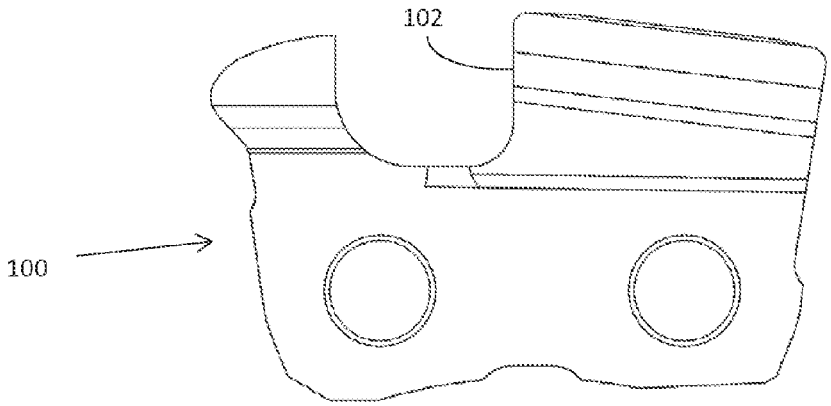
FIGS. 1A-1C illustrate a cutter link with a cutting edge in various stages, namely in its original, manufactured form (FIG. 1A), partially sharpened and still within its useful life (FIG. 1B), and sharpened beyond the cutter link's recommended/useful life (FIG. 1C).

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical contact. However, "coupled" may also mean that two or more elements are not in direct contact with each other, but yet still cooperate or interact with each other.

For the purposes of the description, a phrase in the form "NB" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

Embodiments herein provide a cutter link having an end of life indicator. Such embodiments provide feedback to the user that the saw chain, and more specifically the cutter link(s), has been worn and/or sharpened to an undesirable state or degree.

In an embodiment, there is provided one or more disruptions to the cutting surface of a cutter link in a region that is past the manufacturer's recommended wear limit. When exposed, such disruptions in the cutting surface provide perceptible indications to the user that the chain should no longer be used. The term "exposed" or similar terms refer to a state where a disruption is present at the cutting edge of a cutter link and is capable of degrading performance of the cutting edge and/or providing feedback to the user that the link has been worn/sharpened beyond its recommended useful life.

For the purposes of describing embodiments herein, the term "disruption" or "disruptions" refer(s) to a localized, designed/manufactured difference in the surface or material of a chain saw link that provides feedback to a user that the link has been worn/sharpened beyond its recommended useful life by being exposed at the cutting edge of a cutter link. Disruptions change the cutter link in selected/treated areas, but not the entire cutter link. Even in the vicinity of the disruptions, the disruptions are preferably interspersed with the unadulterated cutter link material.

The disruptions may include, but are not limited to, localized alterations of surface topography through physical grooves or variations in surface texture, localized alterations of material hardness or elemental composition, or localized alterations of coatings applied to a base material, such as the lack of a coating in the end of life region.

In embodiments, the disruptions do not affect the saw chain's performance while operated within the recommended wear range. Once the chain link has reached or exceeded the wear limit, the disruptions are exposed and alter the performance of the saw chain due to their alteration of the cutting edge.

Due to the arrangement and extent of the disruptions, this change of performance can provide visual feedback, as well as non-visual (tactile) feedback to the user that the recommended wear limit has been exceeded. Such tactile feedback is provided in the form of reduced cutting speed for a given applied load, or in the form of a change in force required to sharpen the chain using conventional hand tools. In an example, a less significant disruption may result in a 10% decrease in cutting speed, whereas a more significant disruption may result in a 40% decrease in cutting speed. In another example, if the disruptions are in the form of modified hardness, a softer portion will reduce the force required to sharpen the cutter and a harder portion will increase the force required to sharpen the cutter or may even make the sharpening tool "slip" and not remove any material with a typical user-applied force. Alternatively, the performance degradation noted above can be perceived as a change in the feel of the saw in use on a workpiece, such as by increasing chatter or vibration of the saw.

In embodiments, cutter links may have 1 or more disruptions, whether integrated as 1 functional element forming a single, integrated shape or may be separate from each other forming a discontinuous arrangement of disruptions. For example, there may be 1, 2, 3, 4, 5, 6, 7, or more disruptions. Disruptions may be continuous or discontinuous, such as a segmented or broken groove.

The disruptions may be ordered or may be random in terms of alignment and/or configuration. The disruptions may be aligned with 1 or more features of the cutter link. For example, the disruption(s) may be oriented with the cutting edge of the cutter link such that any cutting edge within the end of life region ("no file zone") will be disrupted along the cutting edge, whether referencing the top plate or side plate of the cutter link.

An example disruption may be a groove formed in the cutting surface of a cutter link. The groove may have a curved, angled, or squared profile or cross-section, or may be a combination of these shapes. A groove may have a depth that extends 5-40% of the thickness of the top or side plate of the cutter link. In an embodiment, a groove may have a depth that extends 20-30% of the thickness of the top or side plate of the cutter link. In an embodiment, a groove may have a width of 0.004-0.010 inches along at least a portion of its length.

The above description references grooves, but it should be understood that the same or similar dimensions apply to changes in material properties. As such, a region that has been differentially heat treated may have softer or harder zones (disruptions) that are, for example, 5-40% of the thickness of the cutter link.

A cutter link may be formed (stamped, pressed, molded) including one or more disruptions, or the disruption(s) may be formed separately, such as by heat treating, etching, grinding, or milling the shape or material change in the cutter link.

In an embodiment in which the disruption is defined by a difference in material hardness, such disruptions may be formed, for example, by selectively heat treating defined regions of a cutter link. As noted above, variations in hardness will affect the force required to sharpen a chain and will affect the performance of the chain. For example, a cutter link may have a hardness of 53-54 Rockwell C, and a disruption may have a hardness that is +/−4-5% of the cutter hardness.

In other embodiments, variations in composition, such as a decarburized section, will tend to behave like a softer section of material. Other variations, such as a carbon-rich section, will tend to behave like a harder section of material.

The hardness and composition changes can both be achieved in similar ways, such as through selective heat treating via induction or via a laser and having the appropriate atmosphere to modify the alloy content in a localized region. The disruptions in plating could be achieved, for example, via masking prior to plating or by removal after plating via etching, grinding, laser ablation, etc.

Thus, in an example, a cutter link may be formed from steel and coated with chrome plating at least on the top plate and side plate of the cutter. Optionally, the cutter link may be tempered. To form disruptions, a laser may be directed onto the cutter link to partially ablate the chrome plating. The application of the laser to the steel of the cutter link draws carbon into the treated area from the surrounding area changing the material composition of the disruption compared to the surrounding area. By adjusting the laser cycle times, the local heat may be controlled to impart the desired shape/depth of the disruptions.

Figure 1B:
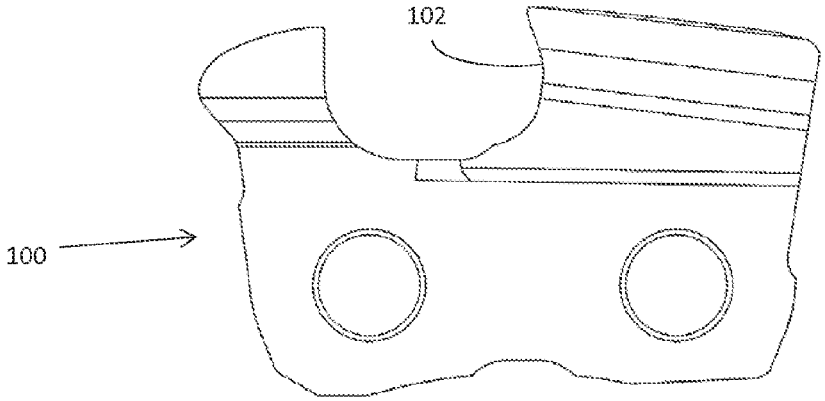
Figure 1C:
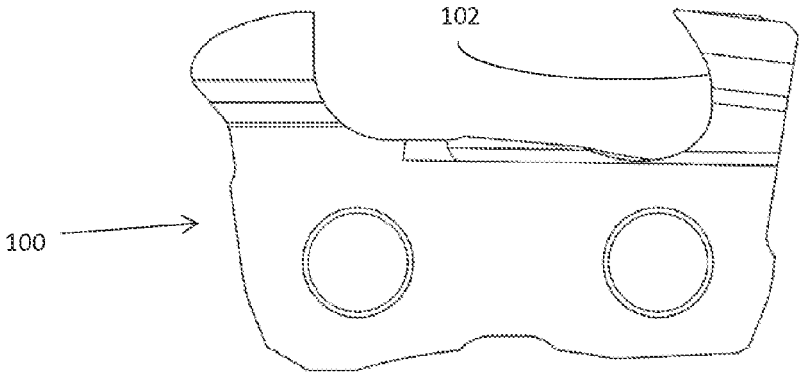

FIGS. 1A-1C illustrate a cutter link 100 with a cutting edge 102 in various stages, namely its original, manufactured form (FIG. 1A), partially sharpened and still within its useful life (FIG. 1B), and sharpened beyond the cutter's recommended/useful life (FIG. 1C).

Figure 2A:
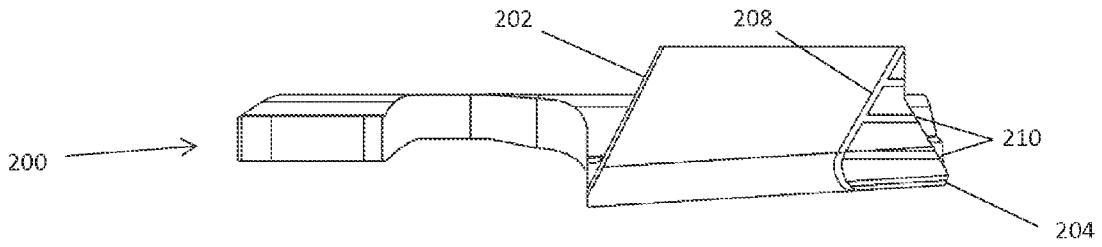
FIGS. 2A-2C illustrate a cutter link with an end of life indicator shown at the trailing end of the cutter, in accordance with various embodiments.
Figure 2B:
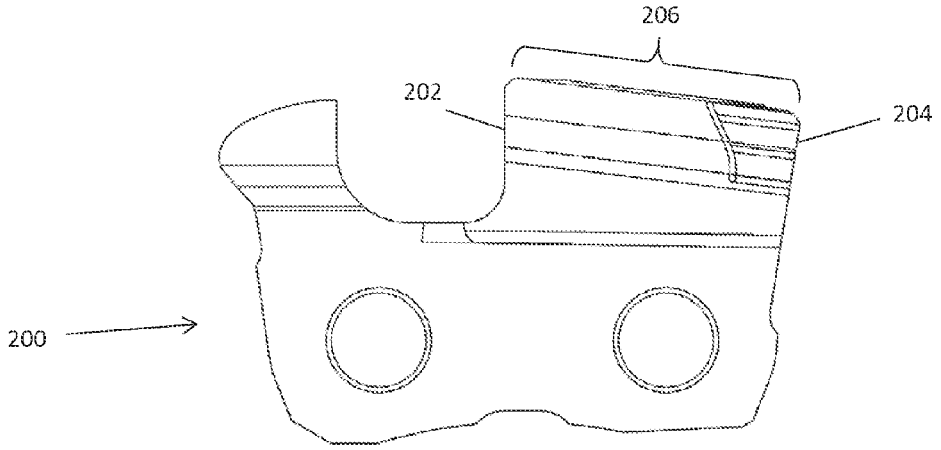
Figure 2C:
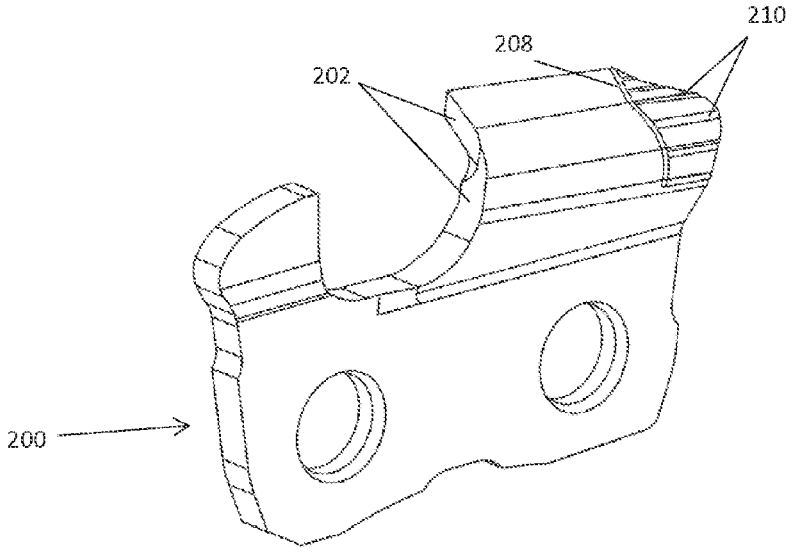

FIGS. 2A-2C illustrate a cutter link 200 with a cutting edge 202 and an end of life indicator 204. Indicator 204 is shown at the trailing end of the cutting surface 206 of cutter link 200. Indicator 204 is defined in part by a limit line 208 demarcating the boundary of the end of life region (the "no-file zone") between the useful portion of the cutting surface and the end of life region. Limit line 208 may itself be a disruption or it may simply be a visual indication of the beginning of the end of life indicator. Disruptions 210 are illustrated as a series of lines or grooves on/in cutting surface 206. In this example, there are six disruptions 210 represented as lines or grooves substantially parallel with the longitudinal axis/plane of and orientation of cutting surface 206.

In embodiments, an end of life indicator may extend a distance of 5-30% along the cutting surface, such that 70-95% of the cutting surface is deemed to be in the useable area. An end of life indicator may begin at or extend to the trailing edge of the cutting surface, or, in an embodiment, it may occupy a region within the cutting surface without extending to the trailing edge.

A limit line, such as limit line 208 described above, may be straight or curved. In an embodiment, a limit line may be parallel to the original cutting edge of the cutter line along some or all of the length of the limit line. A limit line may extend across the entire cutting surface, or it can extend less than the entire cutting surface. As shown for example in FIG. 2C, the limit line extends along the side of the cutting surface. In embodiments, the limit line may extend further along the side of the cutting surface, extending further down the cutter link toward the link body.

As with the limit line, the disruptions may extend across some, all, or a substantial portion of the width of the cutting surface. While one disruption could provide the desired feedback to the user, a series of disruptions spaced along the cutting edge of the cutter link provides a more robust modification of the cutting edge and thus a more readily apparent impact on cutting performance.

Figure 3A:
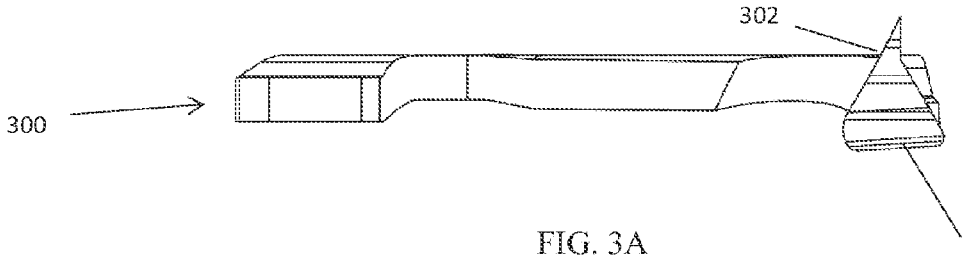
FIGS. 3A-3C illustrate a cutter link with an end of life indicator shown at the trailing end of the cutter, with the cutter link in its original, manufactured form (FIG. 3A), partially sharpened and still within its useful life (FIG. 3B), and sharpened beyond the cutter's recommended/useful life (FIG. 3C) exposing disruptions of the end of life indicator, in accordance with various embodiments.
Figure 3B:
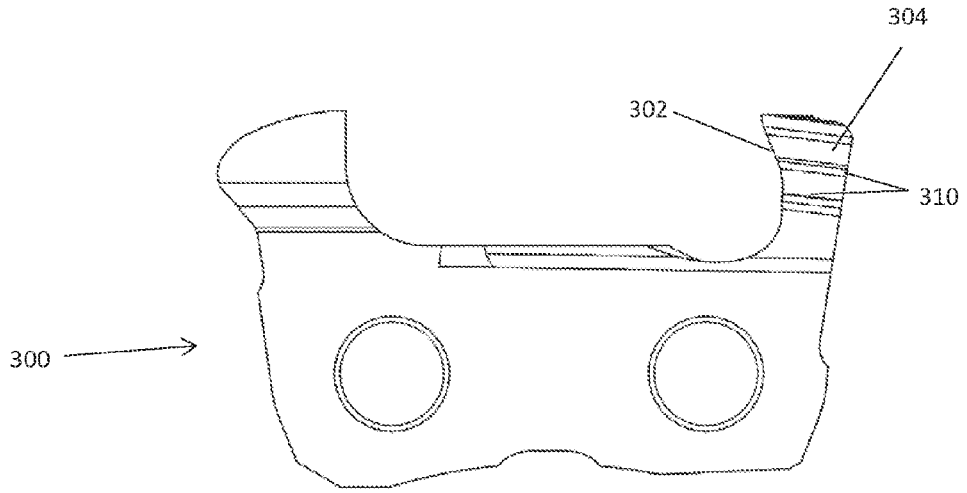
Figure 3C:
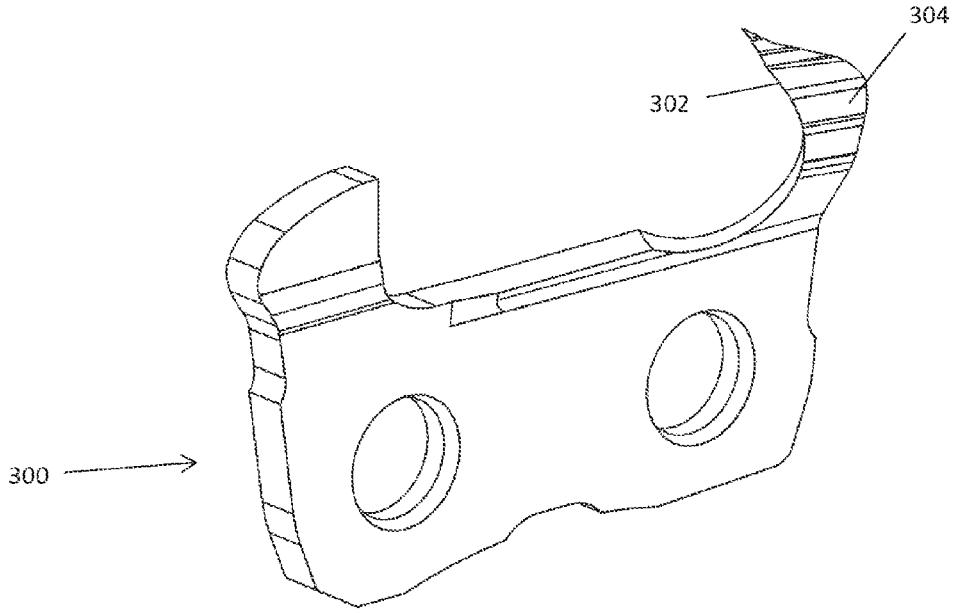

FIGS. 3A-3C illustrate a cutter link 300 with a cutting edge 302 and with an end of life indicator 304 shown at the trailing end of the cutter, with the cutter link 300 in its original, manufactured form (FIG. 3A), partially sharpened and still within its useful life (FIG. 3B), and sharpened beyond the cutter's recommended/useful life (FIG. 3C) exposing disruptions 310 of the end of life indicator 304.

FIGS. 4A-4D show a cutter link 400 in two stages of use/sharpening.

Figure 4A:
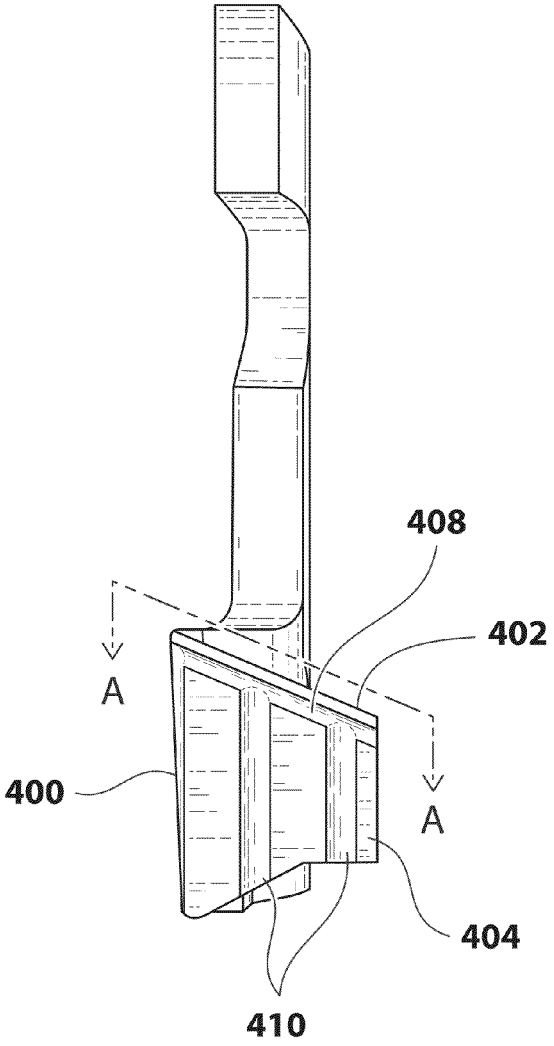
FIGS. 4A-4D show a cutter link in two stages of use/sharpening, in accordance with various embodiments.
Figure 4B:
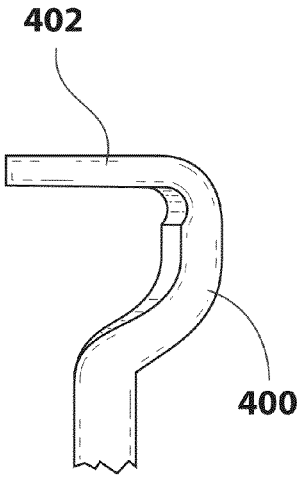

FIGS. 4A and 4B show cutter link 400 with a cutting edge 402 and with an end of life indicator 404 shown on the cutter prior to reaching limit line 408 and exposing the disruptions 410 of the end of life indicator 404. FIG. 4A is a partial top view and FIG. 4B is a front view of cutter link 400.

Figure 4C:
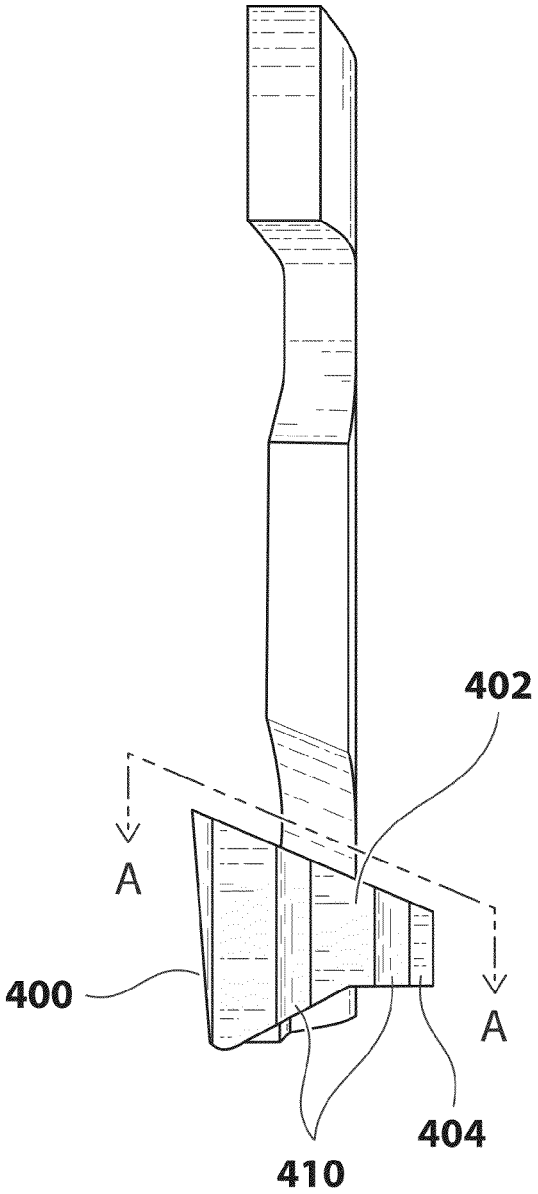
Figure 4D:
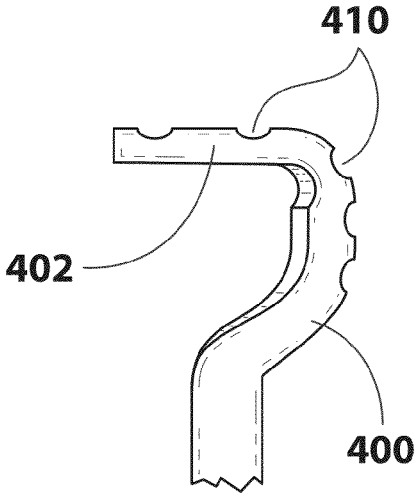

FIGS. 4C and 4D show cutter link 400 having been used/sharpened past limit line 408 exposing disruptions 410. In the partial top view of cutter link (FIG. 4C), disruptions 410 are shown at cutting edge 402. In the front view of cutter link 400 (FIG. 4D), five disruptions 410 are evident.

FIG. 4D, for example, shows cutter link 400 including at least a top plate 418 and a side plate 420 with the top plate 418 and side plate 420 forming an integral body with a continuous cutting edge. The one or more disruptions 410 are present on both the top plate 418 and the side plate 420.

As shown, FIGS. 4A-4D illustrate disruptions 410 as grooves in cutter link 400. Alternatively, instead of grooves, disruptions 410 could be differently treated regions, such as having a lower hardness than the surrounding material of the cutter. In such an embodiment, there would not be an empty groove, but rather a different material or material with different properties defining the disruption. Such a disruption may or may not be visible to the user.

Figure 5A:
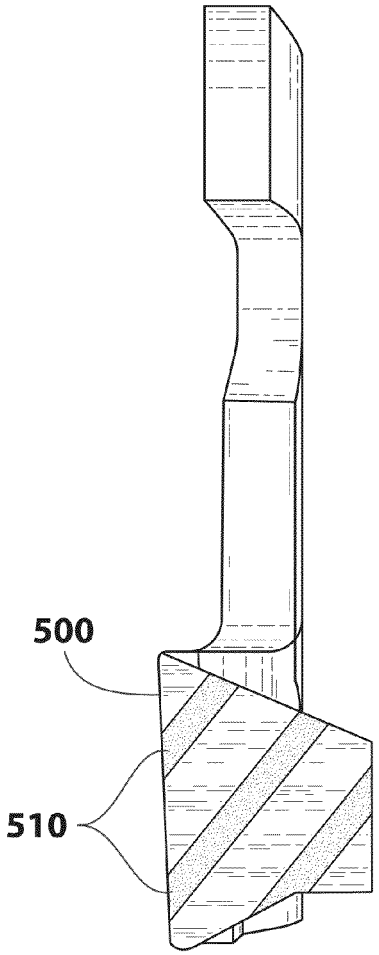
FIGS. 5A and 5B show alternative orientations of disruptions of a cutter link, in accordance with various embodiments.
Figure 5B:
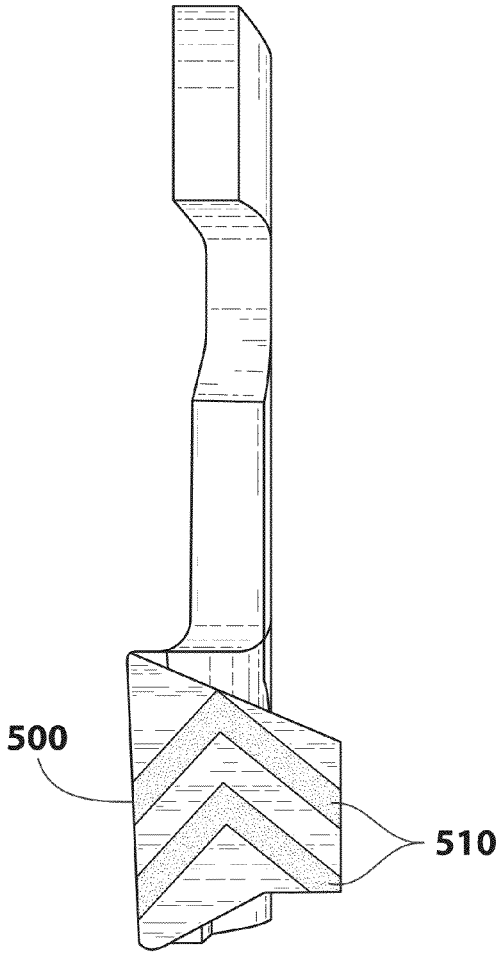

FIGS. 5A and 5B show alternative orientations of disruptions 510. Cutter link 500 is shown with angled disruptions 510. As shown and suggested, a variety of other shapes and configurations of disruptions are within the scope of the present application, whether straight, angled, curved, regular, irregular, ordered, random, etc.

Figure 6A:
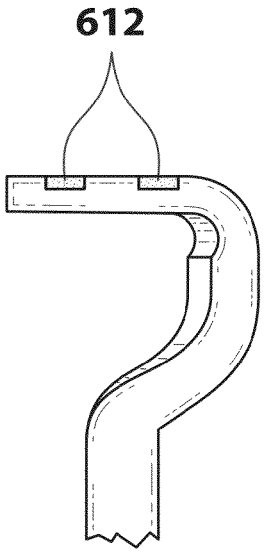
FIGS. 6A-6C show partial front views of various shapes of disruptions, in accordance with various embodiments.
Figure 6B:
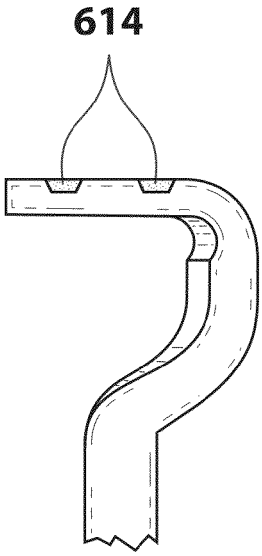
Figure 6C:
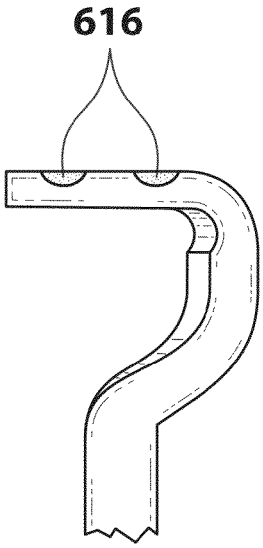

FIGS. 6A-6C show partial front views of various shapes of disruptions 610. A cutter link is shown with squared disruptions 612 (FIG. 6A), angled disruptions 614 (FIG. 6B), and curved disruptions 616 (FIG. 6C).

The following paragraphs describe a number of illustrative examples of some of the embodiments disclosed herein.

Example 1 is a cutter link for a saw chain, including: a cutting surface having a cutting edge and a trailing end; and an end of life indicator located at or toward the trailing end of the cutting surface, the end of life indicator having one or more disruptions configured to provide feedback to a user during use of the saw chain when the one or more disruptions are exposed at the cutting edge of the cutter link.

Example 2 may include the subject matter of Example 1, and may further specify that the one or more disruptions are one or more grooves formed in the cutting surface.

Example 3 may include the subject matter of Example 2, and may further specify that the one or more grooves have a curved, angled, or squared profile.

Example 4 may include the subject matter of Examples 2-3, and may further specify that the one or more grooves extend a depth of 5-40% of the thickness of the cutter link.

Example 5 may include the subject matter of Example 1, and may further specify that the one or more disruptions are defined by a different material property from that of surrounding portions of the cutting surface.

Example 6 may include the subject matter of Example 5, and may further specify that the different material property is material hardness or material composition.

Example 7 may include the subject matter of Example 1, and may further specify that the one or more disruptions are defined by a different surface coating or texture from that of surrounding portions of the cutting surface.

Example 8 may include the subject matter of Examples 1-7, and may further specify that the one or more disruptions are continuous elements.

Example 9 may include the subject matter of Examples 1-7, and may further specify that the one or more disruptions are discontinuous elements.

Example 10 may include the subject matter of Examples 1-9, and may further specify that the one or more disruptions comprises a series of disruptions, the cutter link includes at least a top plate and a side plate, the top plate and side plate forming an integral body with a continuous cutting edge, and the series of disruptions are present on the top plate and the side plate.

Example 11 may include the subject matter of Examples 1-10, and may further specify that the one or more disruptions are configured to provide non-visual feedback to a user during use of the saw chain when the one or more disruptions are exposed at the cutting edge of the cutter link.

Example 12 may include the subject matter of Example 11, and may further specify that the non-visual feedback is tactile feedback.

Example 13 may include the subject matter of Examples 1-12, and may further include a limit line defining a boundary of the end of life indicator.

Example 14 may include the subject matter of Examples 1-13, and may further specify that the end of life indicator extends a distance of 5-30% along the cutting surface.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A cutter link for a saw chain, comprising:

a cutting surface having a cutting edge, a top surface, a side surface, and a trailing end; and an end of life indicator located at or toward the trailing end of the cutting surface, the end of life indicator having a plurality of disruptions disposed along at least one of the top and side surfaces and configured to provide tactile feedback to a user during cutting operation of the saw chain when the plurality of disruptions are simultaneously exposed at the cutting edge of the cutter link due to wear and/or sharpening of the cutting edge, wherein the tactile feedback comprises alteration of the cutting performance of the saw chain when the plurality of disruptions are simultaneously exposed at the cutting edge of the cutter link, and wherein the plurality of disruptions alter cutting performance of the cutter link such that perceptible, tactile feedback is provided to the user when the plurality of disruptions are simultaneously exposed at the cutting edge of the cutter link and the cutter link is engaged with a work piece compared to the cutting performance of the cutter link prior to exposure of the plurality of disruptions at the cutting edge of the cutter link and the cutter link is engaged with a work piece.

2. The cutter link of claim 1, wherein the plurality of disruptions are grooves formed in the cutting surface.

3. The cutter link of claim 2, wherein the grooves have a curved, angled, or squared profile.

4. The cutter link of claim 2, wherein the grooves extend a depth of 5-40% of the thickness of the cutter link.

5. The cutter link of claim 1, wherein the plurality of disruptions are defined by a different material property from that of surrounding portions of the cutting surface.

6. The cutter link of claim 5, wherein the different material property is material hardness or material composition.

7. The cutter link of claim 1, wherein the plurality of disruptions are defined by a different surface coating or texture from that of surrounding portions of the cutting surface.

8. The cutter link of claim 1, wherein the plurality of disruptions are continuous elements.

9. The cutter link of claim 1, wherein the plurality of disruptions are discontinuous elements.

10. The cutter link of claim 1, wherein the tactile feedback comprises a 10%-40% decrease in cutting speed of the saw chain when the plurality of disruptions are simultaneously exposed at the cutting edge of the cutter link.

11. The cutter link of claim 1, further comprising a limit line defining a boundary of the end of life indicator.

12. The cutter link of claim 1, wherein the end of life indicator extends a distance of 5-30% along the cutting surface.

13. The cutter link of claim 1, wherein the plurality of disruptions comprise at least one disruption that is substantially parallel with the longitudinal axis/plane of the cutting surface.

* * * * *